US008582987B2

(12) United States Patent
Yamazaki

(10) Patent No.: US 8,582,987 B2
(45) Date of Patent: Nov. 12, 2013

(54) PRINTING DEVICE

(75) Inventor: Masataka Yamazaki, Kuwana (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 111 days.

(21) Appl. No.: 12/830,541

(22) Filed: Jul. 6, 2010

(65) Prior Publication Data

US 2011/0002721 A1 Jan. 6, 2011

(30) Foreign Application Priority Data

Jul. 6, 2009 (JP) ..... 2009-159884

(51) Int. Cl.

| | |
|---|---|
| ***B41J 29/38*** | (2006.01) |
| ***B65H 43/04*** | (2006.01) |
| ***B65H 15/00*** | (2006.01) |
| ***B65H 85/00*** | (2006.01) |

(52) U.S. Cl.
USPC ..... 399/19; 399/85

(58) Field of Classification Search
USPC ..... 399/401, 18, 19
See application file for complete search history.

(56) References Cited

U.S. PATENT DOCUMENTS

| | | | | |
|---|---|---|---|---|
| 5,937,260 | A | 8/1999 | Taninaka et al. | |
| 6,782,345 | B1 * | 8/2004 | Siegel et al. | 702/183 |
| 8,018,616 | B2 * | 9/2011 | Kadota | 358/1.15 |
| 2002/0149790 | A1 * | 10/2002 | Furuichi | 358/1.15 |
| 2007/0036598 | A1 * | 2/2007 | Toda | 400/62 |
| 2008/0025748 | A1 * | 1/2008 | Ogino et al. | 399/82 |

FOREIGN PATENT DOCUMENTS

| | | | |
|---|---|---|---|
| JP | H02-239058 | A | 9/1990 |
| JP | 10-167526 | | 6/1998 |
| JP | 20000001008 | * | 1/2000 |
| JP | 2002-014575 | A | 1/2002 |
| JP | 2005-067757 | A | 3/2005 |
| JP | 2005-265936 | | 9/2005 |
| JP | 2007-334077 | | 12/2007 |

OTHER PUBLICATIONS

JP 2005265936 machine translation.*
JP 2005067757 machine translation.*
JP 2000001008 machine translation.*
JP 20000001008 EAST abstract.*
Japanese Official Action dated Apr. 19, 2011 together with English language translation from JP 2009-159884.

* cited by examiner

*Primary Examiner* — Matthew G Marini
*Assistant Examiner* — Ruben Parco, Jr.
(74) *Attorney, Agent, or Firm* — Scully, Scott, Murphy & Presser, P.C.

(57) ABSTRACT

In a printing device, the conveying mechanism has a first path from a accommodating unit to the printing position and a second path that conveys the sheet that has once passed through the printing position to the printing position in an inverted state. The controller controls the conveying mechanism to perform an automatic duplex print. Printing on the one side is executed by using the first path and printing on the another side is executed by using the second path. The another side printing error disables printing of an image, by using the second path, on the another side of the sheet, whose one side has already been printed. When the another side printing error occurs, the controller controls the conveying mechanism to convey, through the first path, a sheet and controlling the printing unit to print the image on the sheet based on the set of image data to be printed on the another side.

11 Claims, 9 Drawing Sheets

<2-1 METHOD>

<2-1 METHOD>

<2-4-1-3 METHOD>

<2-4-1-3 METHOD>

<2-4-1-6-3-5 METHOD>

<2-4-1-6-3-5 METHOD>

PRINTING DEVICE

CROSS REFERENCE TO RELATED APPLICATION

This application claims priority from Japanese Patent Application No. 2009-159884 filed Jul. 6, 2009. The entire content of the priority application is incorporated herein by reference.

TECHNICAL FIELD

The invention relates to a printing device capable of performing a duplex print with a switchback mechanism.

BACKGROUND

Some conventional printing devices employ a reversing mechanism (switchback mechanism) to enable duplex printing (i.e., printing on both sides of a sheet). This type of printing device first conveys an unprinted sheet to a prescribed printing position and controls a printing unit to print an image on one side of the sheet. Subsequently, the printing device reverses the sheet with the switchback mechanism, reconveys the sheet to the printing position in an inverted state, and controls the printing unit to print an image on the other side of the sheet.

SUMMARY

However, a printing error can occur during a duplex print with the switchback mechanism when the printing device is attempting to print an image on the second side of the sheet after successfully printing the first side. The conventional printing device described above is not sufficiently configured to handle such printing errors.

In view of the foregoing, it is an object of the invention to provide a printing device capable of appropriately handling printing errors that occur when the printing device is attempting to print the second side of a sheet during a duplex printing operation.

In order to attain the above and other objects, the invention provides a printing device. The printing device includes an accommodating unit, a printing unit, a conveying mechanism, a controller, and a determining unit. The accommodating unit is configured to accommodate a sheet having one side and another side. The printing unit is configured to be capable of printing an image on each side of a sheet based on a set of image data at a printing position. The conveying mechanism has a first path that is configured to convey the sheet from the accommodating unit to the printing position and a second path that is configured to convey the sheet that has once passed through the printing position to the printing position in an inverted state. The controller controls the conveying mechanism to perform an automatic duplex print for printing images on both of the one and another sides of the sheet by using the printing unit. Printing on the one side is executed by using the first path and printing on the another side is executed by using the second path. The determining unit determines whether an another side printing error occurs. The another side printing error disables printing of an image, by using the second path, on the another side of the sheet, whose one side has already been printed, based on a set of image data to be printed on the another side. When the determining unit determines that the another side printing error does not occur, the controller controls the conveying mechanism to convey, through the second path, the sheet whose one side has already been printed to the printing unit and controls the printing unit to print an image on the another side based on the set of image data to be printed on the another side. When the determining unit determines that the another side printing error occurs, the controller controls the conveying mechanism to convey, through the first path, a sheet that is set in the accommodating unit and controlling the printing unit to print the image on the sheet based on the set of image data to be printed on the another side.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
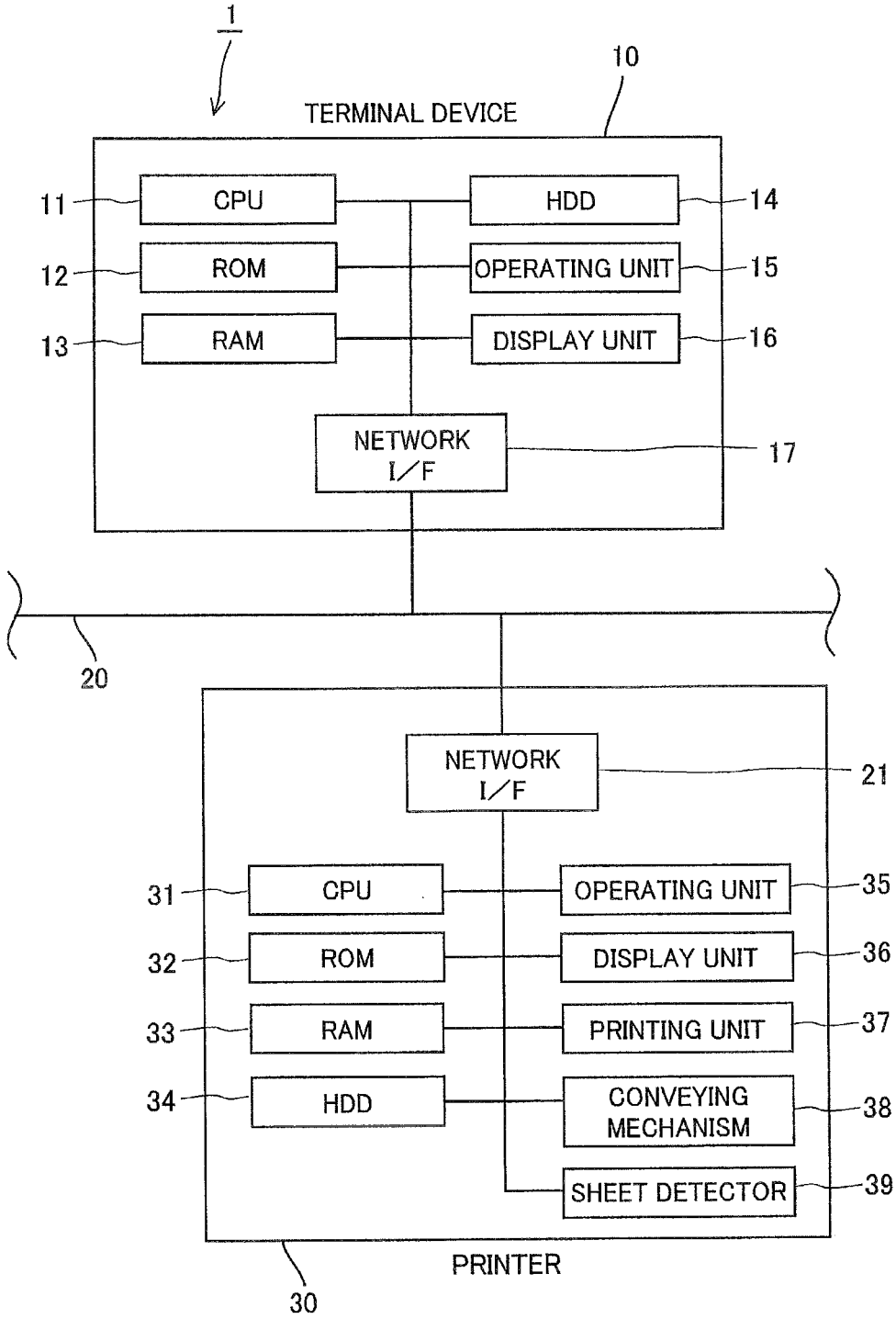
FIG. 1 is a block diagram showing an electrical structure of a printing system of an embodiment.

A printing system 1 according to embodiments of the invention will be described while referring to the accompanying drawings wherein like parts and components are designated by the same reference numerals to avoid duplicating description.

1. Electrical Structure of a Printing System

FIG. 1 is a block diagram showing an electrical structure of the printing system 1 of the embodiment. The printing system 1 is configured of a terminal device 10 such as a personal computer, and a printer 30.

The terminal device 10 is provided with a CPU 11; a ROM 12; a RAM 13; a hard disk drive 14; an operating unit 15 including a keyboard, and pointing device; a display unit 16 configured of a liquid crystal display; and a network interface 17 for connecting to a communication network 20. The hard disk drive 14 stores an operating system (OS), an application program capable of creating data to be printed, and various other programs, such as a printer driver for controlling the printer 30.

The printer 30 includes a CPU 31, a ROM 32, a RAM 33, a hard disk drive 34, an operating unit 35, a display unit 36, a printing unit 37, a conveying mechanism 38, a sheet detector 39, and a network interface 21. The ROM 32 stores various programs for controlling operations of the printer 30, including a duplex print control program for implementing a duplex printing process described later. The CPU 31 controls the operations of the printer 30 while storing results of computations in the RAM 33 during processes executed based on programs read from the ROM 32.

The operating unit 35 includes various buttons by which the user can perform various input operations, such as an operation to input an instruction for initiating a printing operation. The display unit 36 includes a liquid crystal display and various indicator lamps for displaying setup screens, and the status of operations. The printing unit 37 prints an image on a sheet W (a sheet of paper, or a transparency) based on image data. The network interface 21 is connected to an external device such as the terminal device 10 via the communication network 20 and can perform bi-directional communications with the device. The conveying mechanism 38 and sheet detector 39 will be described later.

2. Internal Structure of the Printer

Figure 2:
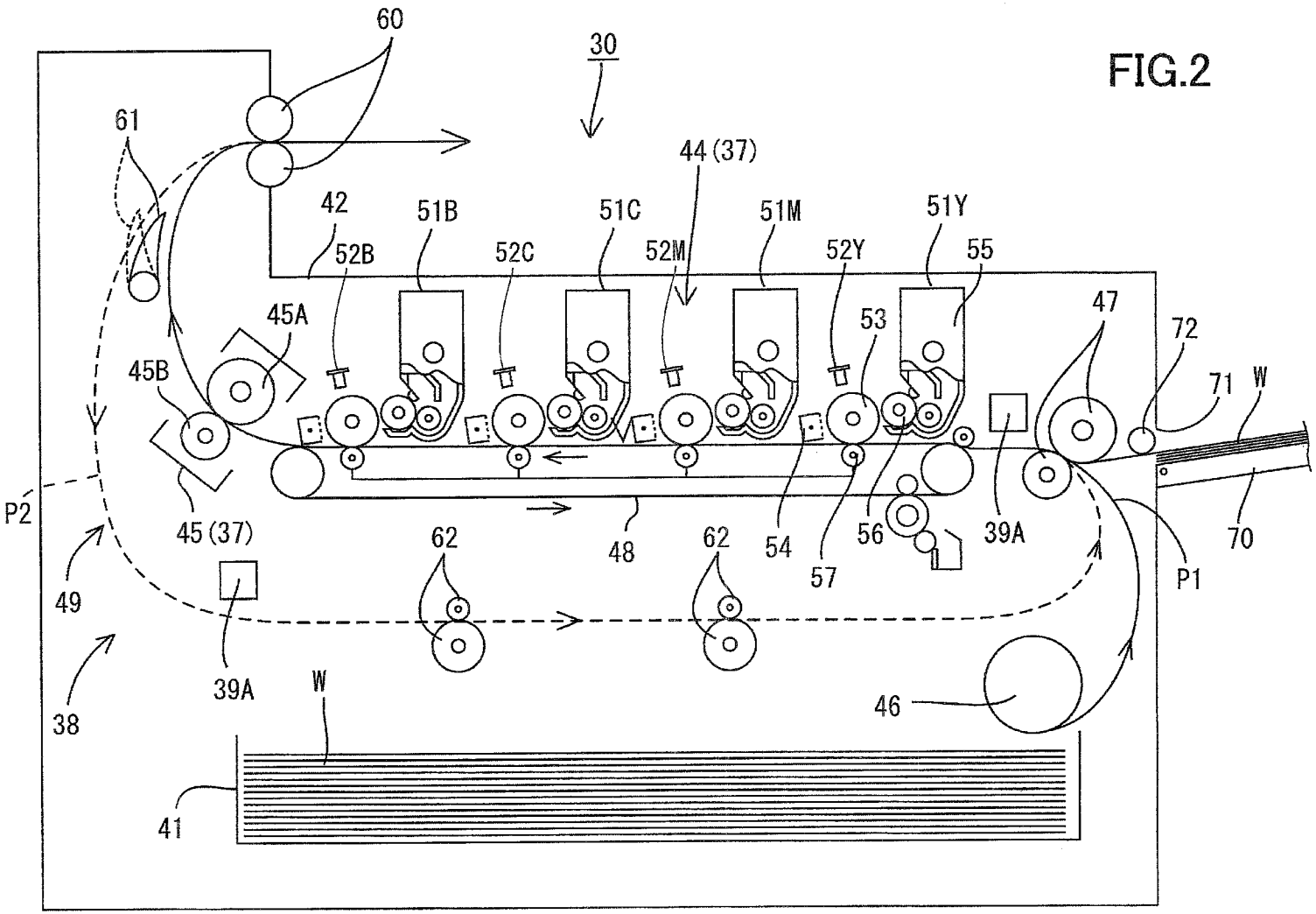
FIG. 2 is a schematic diagram showing an internal structure of a printer.

FIG. 2 is a schematic diagram showing the internal structure of the printer 30. In the following description, one of the letters Y (yellow), M (magenta), C (cyan), and B (black) will be appended to the reference numerals for certain components in the printer 30 when it is desirable to distinguish between components used for different colors. This letter will not be appended when it is not necessary to distinguish the color.

The printer 30 includes a paper tray 41, the printing unit 37 and conveying mechanism 38 described earlier, and a discharge tray 42. The paper tray 41 is disposed in the lower section of the printer 30 and is capable of accommodating a plurality of sheets W.

The printing unit 37 includes a process section 44, and a fixing unit 45. The conveying mechanism 38 includes a pickup roller 46, registration rollers 47, a sheet-conveying belt 48, a conveying path P1, a switchback mechanism 49, and a pickup roller 72. The pickup roller 46 picks up sheets W accommodated in the paper tray 41 and conveys the sheets W to the registration rollers 47 one sheet at a time. When a sheet W is conveyed to the registration rollers 47, the registration rollers 47 correct the orientation of the sheet W and convey the sheet W onto the sheet-conveying belt 48 at a prescribed timing.

The process section 44 has a plurality of process cartridges 51Y, 51M, 51C, and 51B corresponding to each of the plurality of toner colors (four colors in this example), and a plurality (four in this example) of corresponding exposure devices 52Y, 52M, 52C, and 52B. Each process cartridge 51 also has a photosensitive drum 53, a charger 54, and a toner-accommodating section 55. The position on the top of the sheet-conveying belt 48 directly beneath the process section 44 is referred to as the "printing position" in the embodiment.

The charger 54 is a Scorotron charger that functions to apply a uniform charge to the surface of the corresponding photosensitive drum 53. The exposure device 52 has a plurality of light-emitting elements (LEDs, for example) arrayed along the axial direction of the photosensitive drum 53, for example. The plurality of light-emitting elements are controlled to emit light based on image data for the respective color in order to form an electrostatic latent image on the surface of the photosensitive drum 53.

The toner-accommodating section 55 serves to accommodate toner in the respective color (a positive-charging non-magnetic, single-component toner in the embodiment). A developing roller 56 is also disposed in each toner-accommodating section 55. The developing roller 56 charges the toner with a positive polarity and supplies a uniform thin layer of toner to the photosensitive drum 53 for developing the electrostatic latent image formed on the photosensitive drum 53 as a toner image (a monochrome or color image).

A transfer roller 57 is disposed at a position opposing each photosensitive drum 53 with the sheet-conveying belt 48 interposed therebetween. A transfer voltage having the opposite polarity of the charge applied to the toner is applied between the transfer roller 57 and the photosensitive drum 53 for transferring the toner image formed on the photosensitive drum 53 to a sheet W.

Thereafter, the conveying mechanism 38 conveys the sheet W to the fixing unit 45. The fixing unit 45 includes a heating roller 45A and a pinch roller 45B for fixing the toner image to the sheet W as the sheet W passes therebetween and for conveying the sheet W to the discharge tray 42. The conveying path P1 is provided for guiding the sheet W from the paper tray 41 to the printing position on the top of the sheet-conveying belt 48.

The switchback mechanism 49 includes discharge rollers 60, a switchback conveying path P2 indicated by a dotted line in FIG. 2, a flapper 61, and a plurality of switchback conveying rollers 62. When executing an automatic duplex printing operation using the switchback conveying path P2, the process section 44 prints an image on a back side of the sheet W (the bottom surface when the sheet W is accommodated in the paper tray 41), after which the sheet W is conveyed to the discharge rollers 60. Hereinafter, the side of the sheet W on which an image of an even-numbered page is to be printed is referred to as a back side and another side of the sheet W on which an image of an odd-numbered page is to be printed is referred to as a front side.

Next, the discharge rollers 60 are rotated in reverse, and the sheet W is guided by the flapper 61 onto the switchback conveying path P2, after which the switchback conveying rollers 62 convey the sheet W to the registration rollers 47, and the registration rollers 47 convey the sheet W onto the sheet-conveying belt 48 in an inverted state. Hence, the process section 44 can print an image on the front side of the sheet W (opposite side to the front side), and the sheet W is subsequently discharged onto the discharge tray 42.

The sheet detector 39 includes a plurality of sensors 39A. Each sensor 39A outputs a detection signal for a corresponding conveying position within the conveying mechanism 38 indicating whether a sheet W is present at the position. The CPU 31 determines that a paper jam has occurred at one of the conveying positions when a detection signal indicating the presence of a sheet W is received continuously from one of the sensors 39A for a prescribed time or greater or when such signal is not received for a prescribed time or greater. Since one or more sensors 39A are provided along each of the conveying path P1 and the switchback conveying path P2 in the embodiment, as shown in FIG. 2, the CPU 31 can determine when a paper jam has occurred on either the conveying path P1 or the switchback conveying path P2.

A manual feed tray 70 is provided on the front surface of the printer 30 and is capable of opening and closing thereon. An insertion opening 71 is located at the front surface of the printer 30. When the manual feed tray 70 is opened, as shown in FIG. 2, the insertion opening 71 is exposed to the outer space of the printer 30, that is, the outer space of the printer 30 is in communication with the mounted positions of the registration rollers 47 through the insertion opening 71. The pickup roller 72 is disposed near the insertion opening 71 for feeding sheets W placed on the manual feed tray 70 into the insertion opening 71 one sheet at a time. Upon receiving a sheet W conveyed by the pickup roller 72, the registration rollers 47 convey the sheet W into the conveying path P1.

3. Methods of Implementing the Duplex Printing Process

Figure 3A:
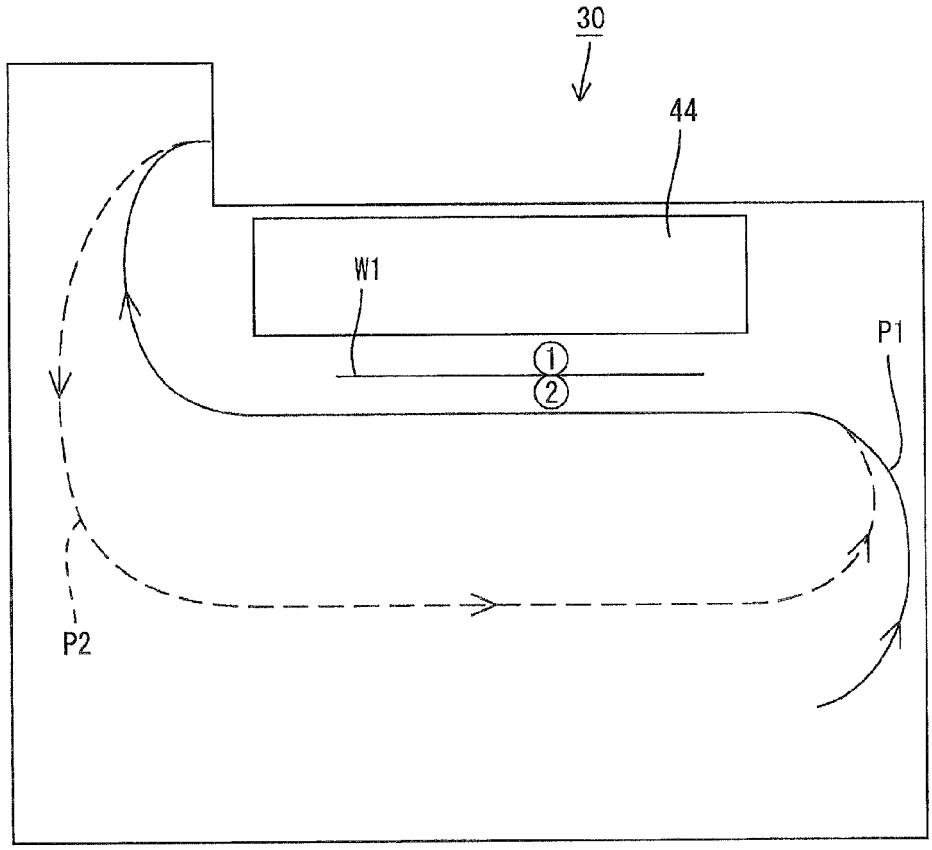
FIG. 3A is a schematic diagram illustrating a 2-1 method.
Figure 3B:
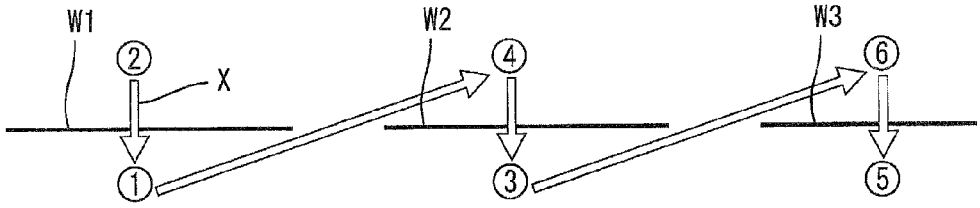
FIG. 3B is an explanation diagram illustrating a printing order of the 2-1 method.
Figure 4A:
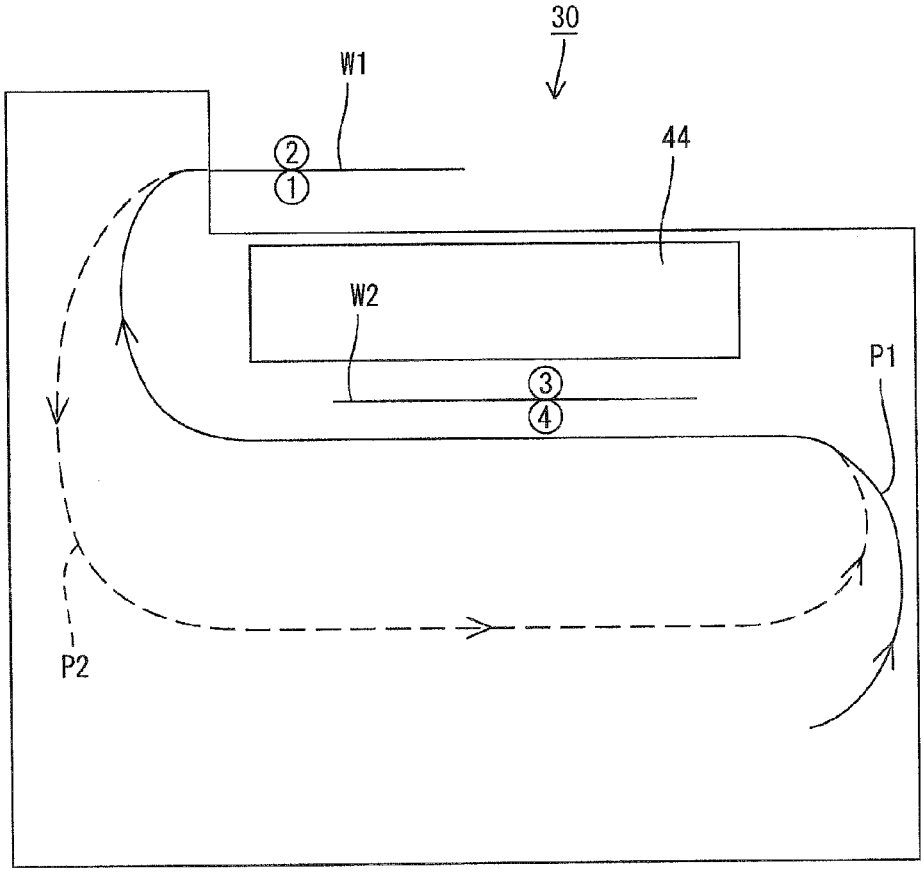
FIG. 4A is a schematic diagram illustrating a 2-4-1-3 method.
Figure 4B:
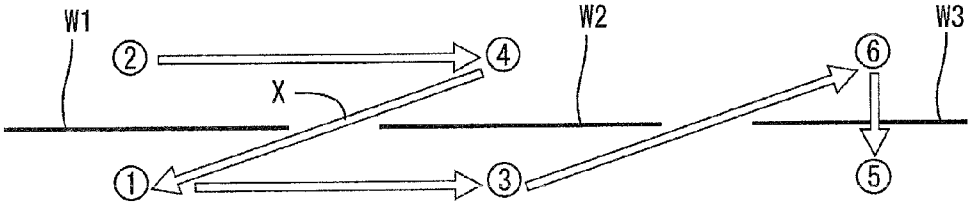
FIG. 4B is an explanation diagram illustrating a printing order of the 2-4-1-3 method.
Figure 5A:
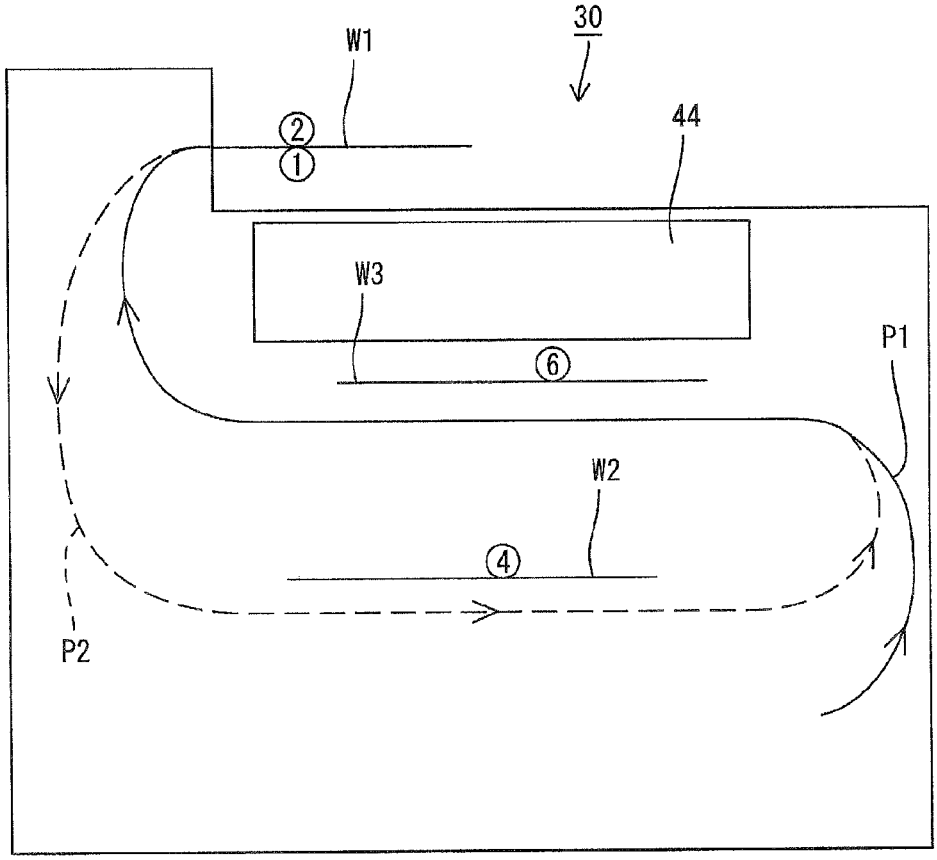
FIG. 5A is a schematic diagram illustrating a 2-4-1-6-3-5 method.
Figure 5B:
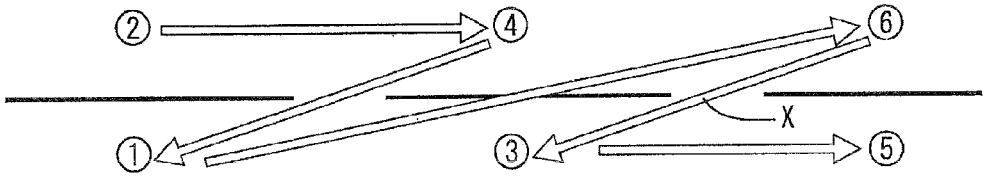
FIG. 5B is an explanation diagram illustrating a printing order of the 2-4-1-6-3-5 method.

FIGS. 3A, 4A, and 5A are schematic diagrams illustrating various methods for implementing a duplex printing process. FIGS. 3B, 4B, and 5B are explanatory diagrams illustrating the printing sequence for each method. In each drawing, marks configured of a circle about a number are attached to sheets W. Here, the number signifies the page number and the position of the mark relative to the sheet W indicates the surface of the sheet W (the front or back surface) on which the image is formed. Each of these marks signifies an image for the page formed on the sheet. Further, the arrows and reference numerals in FIGS. 3B, 4B, and 5B indicate the sequence in which pages are printed on sheets W.

The printer 30 can execute a duplex print that includes operations to print an image on the back side of N (where N is 1 or greater) unprinted sheets (blank sheets W with no printing on the front and back sides) and subsequently to print an image on the front side of M (where M is no greater than N) back-side printed sheets (sheets W that have been printed only on the back sides).

Hereinafter, the number N will be referred to as the number of back-side printed sheets N, and the number M will be referred to as the number of front-side printed sheets M. The printer 30 can selectively execute duplex printing according to a plurality of methods that differ from each other in the number of back-side printed sheets N, the number of front-side printed sheets M, or both. These methods will be classified as manual duplex methods that do not use the switchback mechanism 49 (non-switchback methods), and automatic duplex methods that use the switchback mechanism 49 (switchback methods).

3-1. Manual Duplex Methods

In manual duplex methods, the printer 30 prints only images for even-numbered pages on the back sides of one or a plurality of sheets W and discharges the sheets W onto the discharge tray 42 so that the sheets W are not conveyed along the switchback conveying path P2. Subsequently, the user is prompted to reset the discharged sheets W in the paper tray 41 with the back side (printed surface) facing upward. Thereafter, the printer 30 prints only images for odd-numbered pages on the front sides of the reset sheets W and discharges the sheets W onto the discharge tray 42 without conveying the sheets W along the switchback conveying path P2. Here, the user may also reset the sheets W in the manual feed tray 70 after the back sides have been printed. However, in this case, the sheets W are set in the manual feed tray 70 with the back sides facing downward.

3-2. Automatic Duplex Methods

The automatic duplex methods are classified according to the number of back-side printed sheets N and whether the system is an infinite loop or a finite loop. A finite loop system is a system for repeatedly performing operations to print the back sides of N sheets W and subsequently to print the front sides of the N sheets W. Thus, no back-side printed sheets remain after each finite loop is completed.

An infinite loop system, on the other hand, is a system for printing the back sides of N sheets W and, while subsequently printing the front sides of the N sheets W, for inserting printing operations to print the back sides of new unprinted sheets. Hence, some back-side printed sheets always exist, except at the very start and end of the duplex printing operation. Accordingly, the infinite loop system can achieve a faster printing speed than the finite loop system. However, there is greater potential for the infinite loop system to produce incomplete sheets with an image printed only on the back side due to a printing error occurring when attempting to print the front side of a back-side printed sheet. Next, examples of some specific methods is as follows:

Methods in which N is 1: the 2-1 method (finite loop system)

Methods in which N is 2: the 2-4-1-3 method (finite loop system) and the 2-4-1-6-3-5 (infinite loop system)

Methods in which N is 3: the 2-4-6-1-3-5 method (finite loop system) and the 2-4-6-1-8-3-5-7-9 method (infinite loop system)

The 2-1 method is a finite loop system in which the number of back-side printed sheets N is "1" and the number of front-side printed sheets M is "1". This is a continuous duplex method in which the printer 30 continuously prints the back side followed by the front side of each sheet W throughout the entire printing operation. For example, when printing six pages worth of images on three sheets W in a duplex print, the printer 30 prints images in the following sequence (see FIG. 3B):

Image for page 2 (back side of a first sheet W1)
Image for page 1 (front side of the first sheet W1)
Image for page 4 (back side of a second sheet W2)
Image for page 3 (front side of the second sheet W2)
Image for page 6 (back side of a third sheet W3)
Image for page 5 (front side of the third sheet W3)

As shown in FIG. 3A, after the printer 30 has printed the image for page 2 on the back side of the first sheet W1, the printer 30 does not print second or subsequent sheets W before printing the image for page 1 on the front side of the first sheet W1. Hence, while there is a low probability of incomplete sheets being produced in the 2-1 method, the printing speed is slow.

In the 2-4-1-3 method, the number of back-side printed sheets N is "2" and the number of front-side printed sheets M is "2". This method is a finite loop system for repeatedly performing operations to print the back sides of two sheets W and subsequently to print the front sides of the same two sheets W. For example, when performing a duplex printing operation to print six pages worth of images on three sheets W, the printer 30 prints pages in the following sequence (see FIG. 4B):

Image for page 2 (back side of a first sheet W1)
Image for page 4 (back side of a second sheet W2)
Image for page 1 (front side of the first sheet W1)
Image for page 3 (front side of the second sheet W2)
Image for page 6 (back side of a third sheet W3)
Image for page 5 (front side of the third sheet W3)

As illustrated in FIG. 4B, the printer 30 does not print the image for page 6 on the back side of the third sheet W3 until after printing the image for page 3 on the front side of the second sheet W2. Accordingly, while the 2-4-1-3 method is more likely to produce incomplete sheets than the 2-1 method, the printing speed is faster than the 2-1 method.

In the 2-4-1-6-3-5 method, the number of back-side printed sheets N is "2" and the number of front-side printed sheets M is "1". This method is an infinite loop system in which the printer 30 first prints the back sides of two sheets W, then prints the front side of the first of these two sheets W, and subsequently prints the back side of a new unprinted sheet prior to printing the front side of the second of these two sheets W. For example, when performing a duplex print to print six pages worth of images on three sheets W, the printer 30 prints pages according to the following sequence (see FIG. 5B):

Image for page 2 (back side of a first sheet W1)
Image for page 4 (back side of a second sheet W2)
Image for page 1 (front side of the first sheet W1)
Image for page 6 (back side of a third sheet W3)

Image for page 3 (front side of the second sheet W3)
Image for page 5 (front side of the third sheet W3)

As shown in FIG. 5A, the printer 30 prints an image for page 1 on the front side of the first sheet W1 and subsequently prints the image for page 6 on the back side of the third sheet W3 prior to printing an image for page 3 on the front side of the second sheet W2. Accordingly, the 2-4-1-6-3-5 method has greater potential for producing incomplete sheets W than the 2-4-1-3 method, but has a faster printing speed than the 2-4-1-3 method.

4. Print Control Process

Next, a print control process executed on the printing system 1 according to the embodiment will be described. The print control process includes a process executed on the terminal device 10 and a process executed on the printer 30. These processes will be described separately below.

4-1. Process on the Terminal Device

When the user starts an application program that handles text, and images, and inputs a print request on the operating unit 15, the CPU 11 reads the printer driver mentioned above from the hard disk drive 14 and displays a print setup window (not shown) on the display unit 16. The print setup window allows the user to specify a sheet size, print quality, monochrome/color setting, one-sided/duplex print setting, and method of duplex printing.

After the user sets the desired print conditions in the print setup window and performs a prescribed operation to accept the settings, the terminal device 10 transmits data representing the various print settings (hereinafter, referred to as settings information) entered in the print setup window to the printer 30 and print data (PDL data, for example). More specifically, when the user specifies one-side print setting in the print window, the terminal device 10 transmits settings information indicating that the one-side print is to be performed and image data for each page included in the print data in a sequence corresponding to the one-sided print. In the case of the manual duplex print, the settings information includes a printing condition indicating that the manual duplex print is to be performed. When the user specifies, in the print window, that the manual duplex method is to be performed, the terminal device 10 transmits settings information and image data for each page included in the print data in a sequence corresponding to the manual duplex method. In the case of the automatic duplex print, settings information includes a printing condition indicating that the automatic duplex print is to be performed and a printing condition determining which method of the automatic duplex method (the 2-1 method, or the 2-4-1-3 method, for example) is to be used for the automatic duplex print. When the user specifies, in the print window, that the automatic duplex print is to be performed by using one of the methods of the automatic duplex method (the 2-1 method, or the 2-4-1-3 method, for example), the terminal device 10 transmits settings information and image data for each page in the print data in a sequence corresponding to the automatic duplex method.

The following description of the print control process will assume the following conditions A, B, and C. However, the invention may also be applied to cases in which the following conditions are not met.

A. The user has selected one of the automatic duplex methods as the method of duplex printing.
B. A memory area in the RAM 33 of the printer 30 has been allocated for storing print data received from the terminal device 10, but this memory area can hold only one page worth of image data (bitmap data or the like), for example. Hence, after receiving one page worth of image data from the terminal device 10, the printer 30 cannot receive image data for the next page until an operation to print the current page worth of image data on a sheet W has been completed.
C. While the printer 30 is performing a duplex print, the roller components of the conveying mechanism 38 are continuously driven to rotate. Thus, after the pickup roller 46 supplies a sheet W from the paper tray 41 or after the pickup roller 72 supplies a sheet W from the manual feed tray 70, the sheet W is conveyed by the conveying mechanism 38 without halting until the printer 30 has completed the duplex printing operation and has discharged the sheet W onto the discharge tray 42. During duplex printing, the heating roller 45A and the pinch roller 45B rotate continuously to maintain the heating temperature of the fixing unit 45 at a uniform level. Since the components in the conveying mechanism 38 and the fixing unit 45 are driven to rotate by a common motor (not shown), for example, the components in the conveying mechanism 38 must be continuously driven to rotate when the heating roller 45A and the pinch roller 45B are continuously rotated. Consequently, the sheet W is conveyed without halting during a duplex printing process.

4-2. Process on the Printer

When the printer 30 (the network interface 21) receives the print data and print settings information from the terminal device 10, the CPU 31 of the printer 30 analyzes the print settings information to determine whether the one-sided print, the manual duplex print or the automatic duplex print setting has been specified. When the one-sided print setting has been specified, the CPU 31 initiates a process to expand image data for each page received in sequence from the terminal device 10 into bitmap data according to the settings information, and instructs the printing unit 37 to perform a one-sided printing operation on an unprinted sheet. When the manual duplex print setting has been specified, the CPU 31 initiates a process to expand image data for each page received in sequence from the terminal device 10 into bitmap data according to the settings information, and instructs the printing unit 37 to perform a manual duplex printing operation on an unprinted sheet. When the automatic duplex print setting has been specified, the CPU 31 initiates a process to expand image data for each page received in sequence from the terminal device 10 into bitmap data according to the printing conditions, and subsequently executes the automatic duplex printing process described next.

Figure 6:
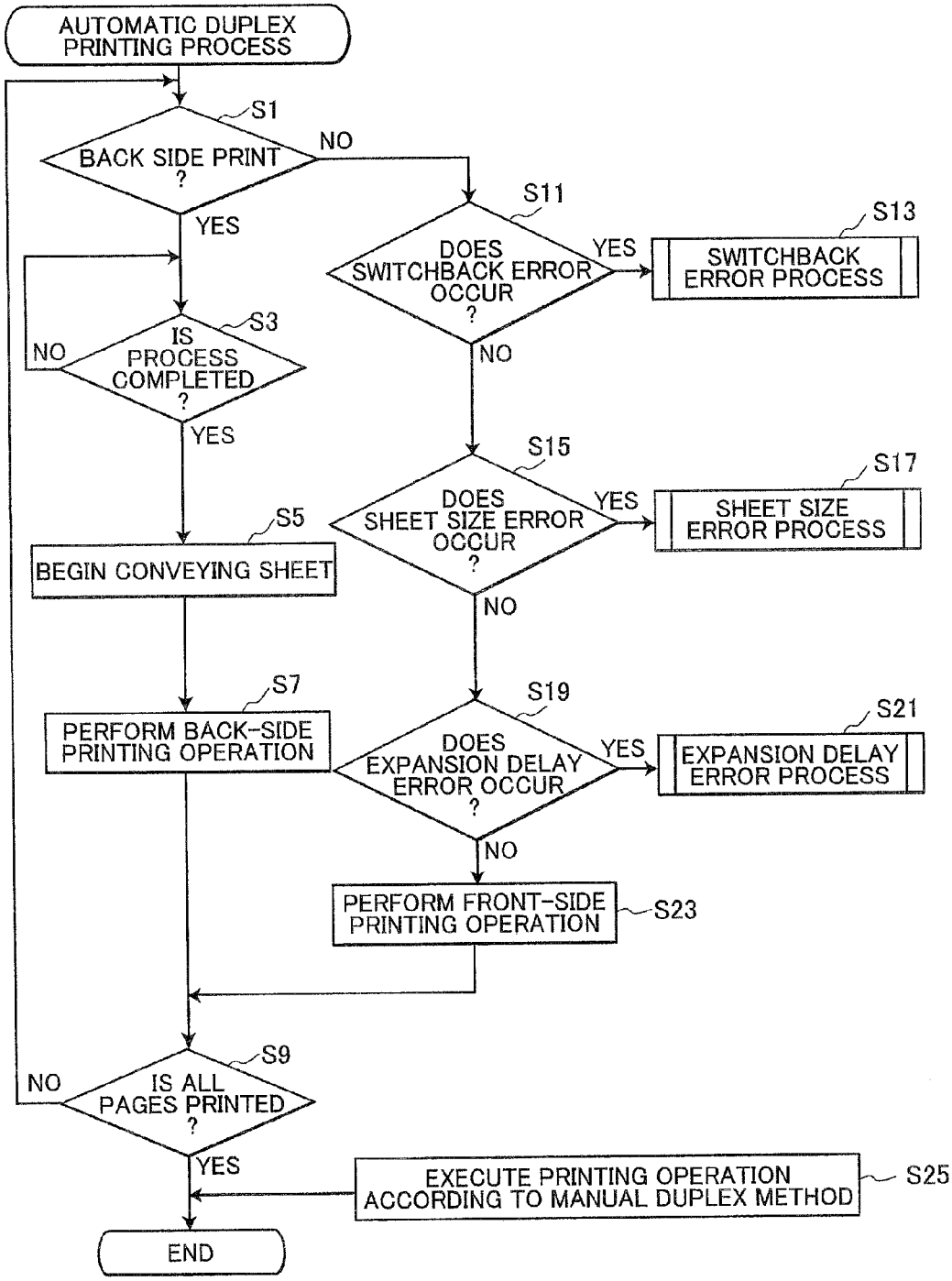
FIG. 6 is a flowchart illustrating steps in a duplex printing process.

FIG. 6 is a flowchart illustrating steps in the automatic duplex printing process executed on the printer 30. By executing this duplex printing process, the printer 30 can suitably handle front-side printing errors when such errors occur. This error handling will be described in greater detail below.

In S1 the CPU 31 determines whether the current printing operation is a back-side printing operation in which the back side of the sheet W is printed. In the back-side printing operation, an image of an even-numbered page is printed on the sheet W. In other words, the CPU 31 determines whether the image data to be used in the current printing operation (i.e., the image data expanded in the allocated memory area in the RAM 33 described above) is image data to be printed on the back side of the sheet W (image data for an even-numbered page in the embodiment).

4-2-1. Back-Side Printing Operation

If the CPU 31 determines that the current printing operation is a back-side printing operation (S1: YES), in S3 the CPU 31 determines whether the process to develop image data for printing on the back side has been completed and continues to wait while the process has not been completed (S3: NO). Once the development process has been completed (S3: YES), the CPU 31 controls the pickup roller 46 or the pickup roller 72 to pick up one unprinted sheet from the paper tray 41 or the manual feed tray 70 and to begin conveying the sheet toward the printing position.

In S7 the CPU 31 controls the printing unit 37 to execute a back-side printing operation on the unprinted sheet. In S9 the CPU 31 determines whether all pages of the image data have been printed. The CPU 31 returns to S1 if there remains any image data to print (S9: NO), and ends the duplex printing process when all pages of the image data have been printed (S9: YES).

4-2-2. Front-Side Printing Operation

If the CPU 31 determines in S1 that the current printing operation is a front-side printing operation (S1: NO), then the CPU 31 determines whether a front-side printing error has occurred during the front-side printing operation through steps S11, S15, and S19. When the CPU 31 determines that a front-side printing error has not been occurred (S11: No, S15: NO, S19: NO), the CPU 31 performs in S23 a front-side printing operation to print an image on the front side of the sheet W and proceeds to S9. Here, in the front-side printing operation, an image of an odd-numbered page is printed on the front side of the sheet W. Possible front-side printing errors that may occur in the embodiment are a switchback error, a sheet size error, and an expansion delay error. Each type of error and the method of resolution implemented in the embodiment will be described next in detail.

(1) Switchback Error

In S11 the CPU 31 determines whether a switchback error has occurred. A switchback error is an event in which a sheet W cannot be properly conveyed onto the switchback conveying path P2 after the back side has been printed. This switchback error occurs if the sheet W becomes jammed in the switchback conveying path P2 or the like after the back side has been printed or if the user forcibly removes the sheet W that is positioned at the discharge rollers 60 after the back side has been printed.

The CPU 31 determines whether a switchback error has occurred based on whether detection signals have been received from the sensors 39A and, if received, the duration of the signals. When the CPU 31 determines that a switchback error has occurred (S11: YES), the CPU 31 halts the duplex printing process of the printing unit 37 and the conveying operation of the conveying mechanism 38 and executes a switchback error process in S13. Since the CPU 31 halts the duplex printing process and the conveying operation when a switchback error occurs, the user can take measures to resolve the switchback error during the stoppage.

Figure 7:
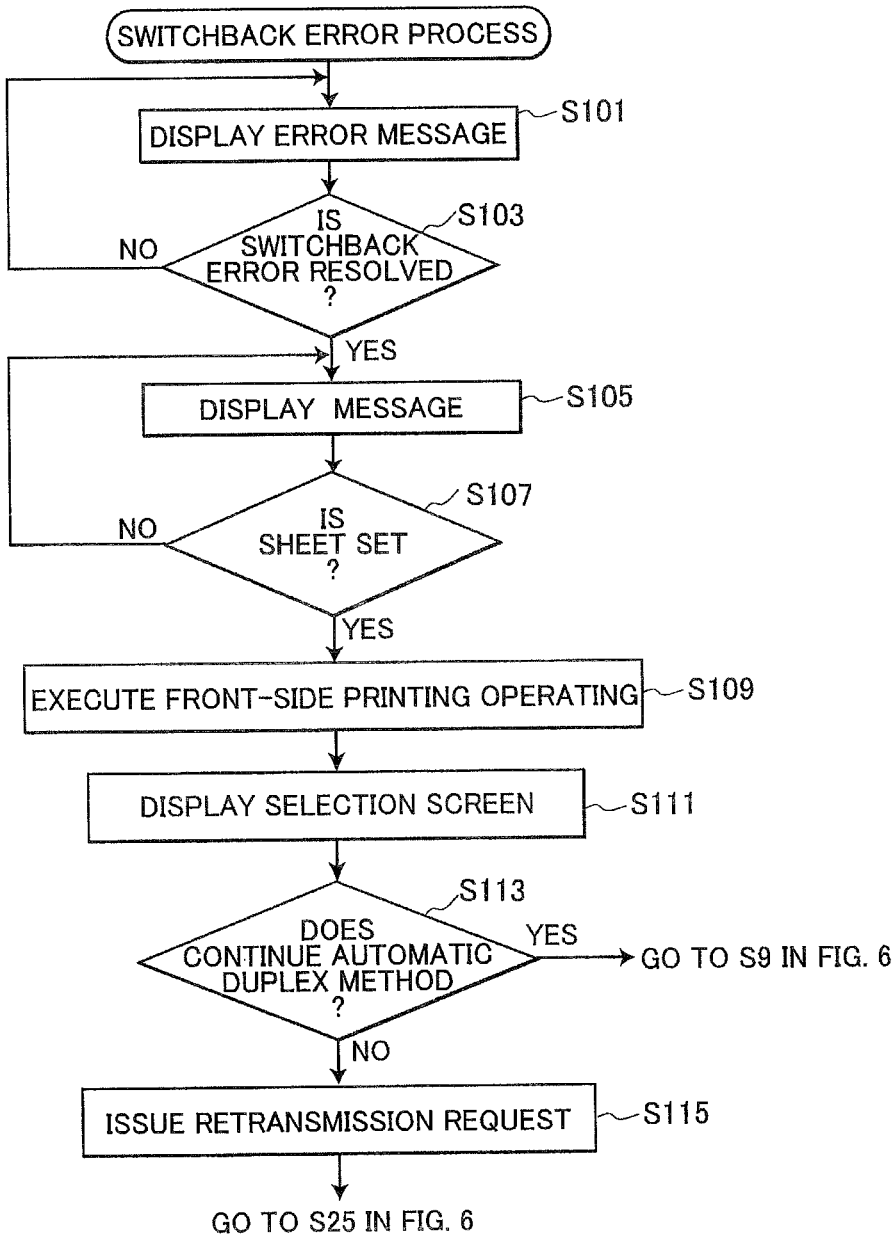
FIG. 7 is a flowchart illustrating steps in a switchback error process.

FIG. 7 is a flowchart illustrating steps in the switchback error process. In S101 of FIG. 7, the CPU 31 displays an error message with graphics on the display unit 36 indicating that a switchback error has occurred. This display alerts the user that a switchback error has occurred, enabling the user to take measures to resolve the switchback error. The user removes a back-side printed sheet, whose back side has been already printed with an image and whose front side has not yet been printed with an image, from the printer 30, for example.

In S103 the CPU 31 determines whether the switchback error has been resolved based on detection signals received from the sensors 39A, or input by the user on the operating unit 35. When the CPU 31 determines that the switchback error has been resolved (S103: YES), in S105 the CPU 31 displays a message on the display unit 36 directing the user to set the back-side printed sheet W in the manual feed tray 70.

At this time, the user sets, in the manual feed tray 70, the back-side printed sheet which he/she has removed from printer 30. The CPU 31 prompts the user with a message on the display unit 36 to set this sheet in the manual feed tray 70 with the front side (unprinted surface) facing upward.

In S107 the CPU 31 determines whether a sheet W has been set in the manual feed tray 70 based on a detection signal received from a sheet sensor (not shown). When the CPU 31 determines that a sheet W has been set in the manual feed tray 70 (S107: YES), in S109 the CPU 31 controls the conveying mechanism 38 to begin conveying the sheet W set in the manual feed tray 70 onto the conveying path P1 and executes a front-side printing operation on the sheet W. Through this process, the printer 30 can print a front-side image that has not been printed due to the switchback error on the back-side printed sheet. Moreover, since the switchback conveying path P2 is not used in this front-side printing operation, the printer 30 can avoid a recurrence of the switchback error.

It is noted that in response to the message displayed in S105, the user may set the back-side printed sheet W in the paper tray 41 instead of the manual feed tray 70. For example, in S105 the printer 30 may urge the user to set the back-side printed sheet W in the paper tray 41 rather than in the manual feed tray 70. In this case, the CPU 31 displays a message on the display unit 36 prompting the user to set the back-side printed sheet W in the paper tray 41 with the front side (unprinted surface) facing downward and prompting the user to input, by the operating unit 35, information indicating that the user has set the back-side printed sheet in the paper tray 41 after he/she sets the sheet in the paper tray 41. In this case, in S107 the CPU 31 determines whether the sheet W has been set in the paper tray 41 based on the input information by the user. If a positive determination is made (S107: YES), the CPU 31 controls the conveying mechanism 38 to begin conveying the sheet W in the paper tray 41 onto the conveying path P1 and executes a front-side printing operation on the sheet W.

In S111 the CPU 31 displays a selection screen on the display unit 36 asking the user whether to continue the print job according to the automatic duplex method or to switch to a manual duplex method. In S113 the CPU 31 determines whether the user has indicated a desire to continue the automatic duplex method based on a user-operation performed on the operating unit 35. If the user has indicated a desire to continue the automatic duplex method (S113: YES), the CPU 31 returns to S9 of FIG. 6 and determines whether all pages of the printing operation have been completed. If there remain pages to be printed (S9: NO), the CPU 31 continues the duplex printing operation on the next page of image data based on the automatic duplex method.

However, if the user has selected the manual duplex method (S13: NO), in S115 the CPU 31 issues a retransmission request to the terminal device 10 to retransmit image data for the unprinted pages in a sequence based on the manual duplex method. Accordingly, the CPU 31 eliminates the need to perform a process on the printer 30 for reordering image data in a sequence based on the manual duplex method. Further, all image data on the printer is discarded prior to this retransmission. Next, the CPU 31 advances to S25 of FIG. 6, executes a printing operation based image data of on the unprinted pages according to the manual duplex method, and subsequently ends the duplex printing process.

In this manual duplex method, the CPU 31 displays instructions on the display unit 36 prompting the user to set unprinted sheets in the manual feed tray 70. After printing the back sides of these unprinted sheets, the CPU 31 displays instructions on the display unit 36 prompting the user to reset the back-side printed sheets in the manual feed tray 70 with the unprinted surfaces facing upward. Alternatively, the CPU 31 may display instructions on the display unit 36 at this time prompting the user to reset the back-side printed sheets in the paper tray 41 with the unprinted surfaces facing downward.

Next, a duplex printing process according to the 2-1 method shown in FIG. 3B will be described for a case in which a switchback error occurs after the printer 30 has printed an image for page 2 on the back side of the first sheet W1 (at the point indicated by an X in FIG. 3B). When the switchback error occurs, the user is prompted in S105 to reset the first sheet W1 on which an image for page 2 has already been printed in the manual feed tray 70 with the unprinted surface facing upward based on instructions displayed on the display unit 36. Accordingly, the printer 30 prints in S109 an image for page 1 on the unprinted surface of the first sheet W1 without using the switchback conveying path P2.

If the user subsequently selects the manual duplex method (S113: NO), in S115 the printer 30 issues a retransmission request to the terminal device 10. In response, the terminal device 10 retransmits image data for the unprinted pages in the sequence page 4, page 6, page 3, and page 5 to the printer 30. Next, in the manual duplex process of S25 the user is prompted to set two sheets W in the manual feed tray 70, and the printer 30 prints images for pages 4 and 6 on the back sides of these sheets W, discharging the sheets W onto the discharge tray 42.

Next, the user is prompted to reset the discharged sheets W in the manual feed tray 70 with the unprinted surfaces (front sides) facing upward. In this way, the printer 30 can print an image for page 3 on the front side of the sheet having the image for page 4 printed on the back side thereof and can print an image for page 5 on the front side of the sheet already having the image for page 6 printed on the back side thereof, discharging the sheets sequentially onto the discharge tray 42. According to this manual duplex method, the printer 30 can perform duplex printing for the unprinted pages without using the switchback conveying path P2.

Next, a duplex printing process according to the 2-4-1-3 method shown in FIG. 4B will be described for a case in which a switchback error occurs after the printer 30 has printed an image for page 4 on the back side of the first sheet W2 (at the point indicated by an X in FIG. 4B). That is, the back-side printing operations have been performed on more than one sheet W (W1 and W2 in this example), and the switchback error occurs before the front-side printing operations are started being executed on the more than one back-side printed sheet W. In this case, in S109 the CPU 31 executes the front-side printing operation for one of the back-side printed sheets W that has printed first among the more than one back-side printed sheet (W1 in this example). Subsequently, if the user indicates a desire to continue the automatic duplex method (S113: YES), the user sets the remaining back-side printed sheet (W2 in this example) in the manual feed tray 70 with the back-side printed surface facing upward, the CPU 31 conveys the back-side printed sheet through the conveying path P1 without printing any image on the back sides of the sheet, conveys the sheet through the switchback conveying path P2, and conveys the sheet through the conveying path P1 again while printing image on the front side of the sheet at this time. The user may set the remaining back-side printed sheet in the paper tray 41 rather than in the manual feed tray 70 with the back-side printed surface facing downward. In this case, the CPU 31 executes the front-side printing operation by conveying the back-side printed sheet through the conveying path P1 without printing any image on the back side of the sheet, conveying the sheet through the switchback conveying path P2, and conveying the sheet through the conveying path P1 while printing image on the front side of the sheet.

(2) Sheet Size Error

If the CPU 31 determines in S11 that a switchback error has not occurred (S11: NO), in S15 the CPU 31 determines whether a sheet size error has occurred. A sheet size error occurs when the sheet W supplied from the paper tray 41 or the manual feed tray 70 is of a size that cannot be conveyed in reverse along the switchback conveying path P2. Thus, a sheet size error occurs when the sheet W is shorter than the distance between neighboring switchback conveying rollers 62 along the conveying path P2, for example.

The CPU 31 measures the size of the sheet W based on the duration of the detection signal received from one of the sensors 39A that is located between the registration rollers 47 and the process section 44 along the conveying path P1, for example, and determines whether a sheet size error has occurred based on this measurement. When the CPU 31 determines that a sheet size error has occurred (S15: YES), the CPU 31 halts the duplex printing process and the conveying operations of the conveying mechanism 38 and executes a sheet size error process in S17. Since the CPU 31 halts operations of the printing unit 37 and the conveying mechanism 38 when a sheet size error occurs, the CPU 31 can prevent a paper jam from actually occurring on the switchback conveying path P2 as a result of the incorrect sheet size.

Figure 8:
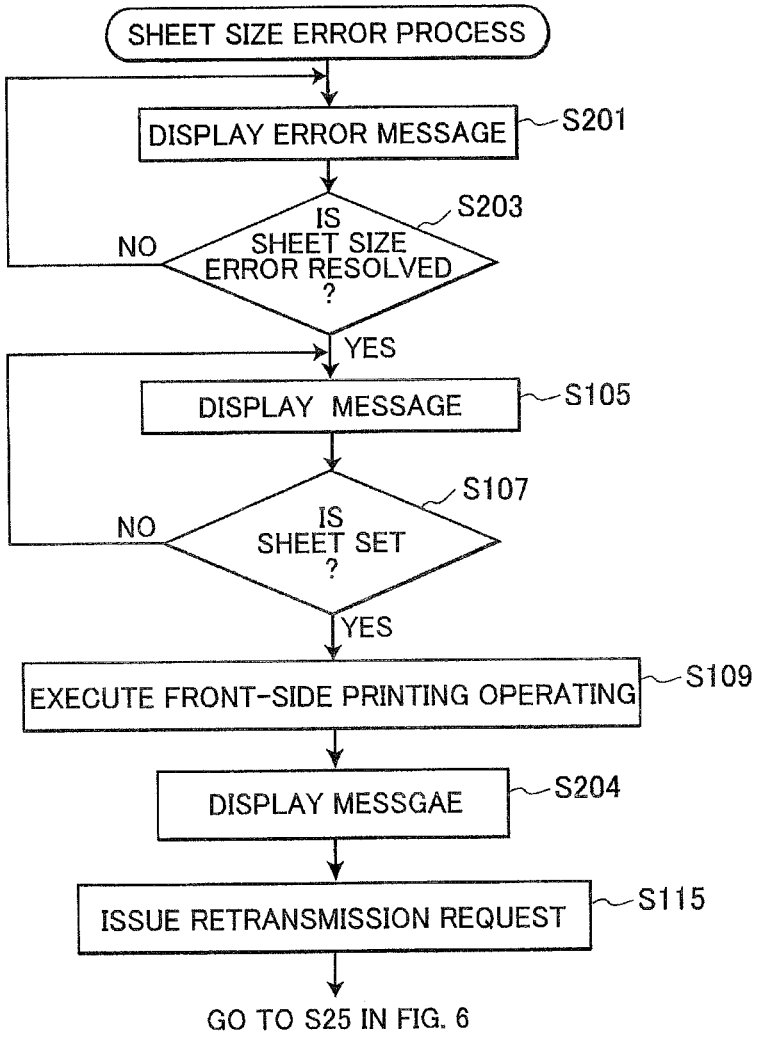
FIG. 8 is a flowchart illustrating steps in a sheet size error process.

FIG. 8 is a flowchart illustrating steps in the sheet size error process. Since this process is similar to the switchback error process of FIG. 7, same steps have been designated with the same step numbers to avoid duplicating description. In S201 of FIG. 8 the CPU 31 displays an error message with graphics on the display unit 36 to indicate that a sheet size error has occurred. This display informs the user that a sheet size error has occurred and enables the user to take measures to resolve the error. For example, the user can reload the paper tray 41 with sheets W of the correct size, removes one or more back-side printed sheet which is now in the conveying path and whose back side has been already printed with an image from the printer 30, and the user inputs, by using the operating unit 35, information specifying that the sheet size error is resolved. Alternatively, the conveying mechanism 38 may convey and discharge the one or more back-side printed sheet on the discharge tray 42 without printing an image on the front side.

In S203 the CPU 31 determines whether the sheet size error has been resolved based on a detection signal from one of the sensors 39A that is located between the registration rollers 47 and the process section 44 along the conveying path P1, or information inputted by the user using the operating unit 35, for example. If the CPU 31 determines that the error has been resolved (S203: YES), the CPU 31 executes the processes of S105, S107, and S109 described above. In S204 the CPU 31 displays a message on the display unit 36 indicating that the duplex printing method will be switched to the manual duplex method. The same message may also be displayed on the display unit 16 of the terminal device 10. In S115 the CPU 31 issues a retransmission request to the terminal device 10 to transmit image data in an order corresponding to the manual duplex method, advances to S25 of FIG. 6 to execute the manual duplex method based on image data for the remaining unprinted pages, and subsequently ends the duplex printing process.

Next, a duplex printing operation according to the 2-4-1-6-3-5 method shown in FIG. 5B will be described in detail for a case in which a sheet size error has occurred after the printer 30 has printed an image for page 6 on the back side of the third sheet W3 (at the point indicated by X in FIG. 5B). When a sheet size error occurs in this example, the printer 30 displays in S105 instructions on the display unit 36 prompting the user to reset the second sheet W2 on which the image for page 4 has been printed in the manual feed tray 70 with the unprinted surface facing upward. Accordingly, the printer 30 can print in S109 an image for page 3 on the unprinted surface of the second sheet W2 without using the switchback conveying path P2.

Subsequently, the printer 30 switches in S115 to the manual duplex method and issues a retransmission request to the terminal device 10. In response, the terminal device 10 retransmits image data for pages of the sheet on which the printer 30 has not printed images completely, to the printer 30 in the sequence according to the manual duplex print (in the sequence page 6, page 5, in the example). If the user sets the third sheet W3 having the image of page 6 printed thereon in the manual feed tray 70, the printer 30 simply conveys the third sheet W3 without printing an image for page 6 and discharges the third sheet W3 onto the discharge tray 42.

Next, the user is prompted to reset the discharged third sheet W3 in the manual feed tray 70 with the unprinted surface (front side) facing upward. Accordingly, the printer 30 prints an image for page 5 on the front side of the sheet already having the image for page 6 on the back side and discharges this sheet onto the discharge tray 42. Hence, the CPU 31 can perform duplex printing of images for the pages of the sheet on which the printer 30 has not printed image completely, based on the manual duplex method that does not use the switchback conveying path P2.

(3) Expansion Delay Error

When the CPU 31 determines that neither a switchback error nor a sheet size error has occurred (S11: NO and S15: NO), in S19 the CPU 31 determines whether an expansion delay error has occurred. An expansion delay error occurs when a process for expanding the front-side image data is not complete by the time the back-side printed sheet has been conveyed through the switchback conveying path P2 to the printing position. An expansion delay error can occur when the print data transmitted from the terminal device 10 is delayed due to congestion on the communication network 20 or when the expansion process takes too much time due to a large amount of print data for the page, for example.

Since the printer 30 of the embodiment has a small memory area, as described above, the printer 30 cannot begin the expansion process for the next front-side image data until the operation to print image data on the back side of the sheet W is completed (condition B above). Moreover, after the pickup roller 46 or the pickup roller 72 feeds the sheet W from the paper tray 41 or the manual feed tray 70, the sheet W is continuously conveyed during the duplex print without stopping (condition C above). Accordingly, after an image has been printed on the back side of the sheet W, the sheet W is conveyed to the printing position, regardless of whether the expansion process for the front-side image data is complete.

An expansion delay error will not occur during the printing operation, such as the back-side printing operation described above, a one-sided printing operation, or a printing operation according to the manual duplex method, that is executed for the first time on a sheet W after the sheet W is supplied from the paper tray 41 or the manual feed tray 70. The reason that an expansion delay error does not occur in this case is as follows. The pickup roller 46 and the pickup roller 72 continue to rotate along with the rotating components of the conveying mechanism 38 during a duplex printing operation, but are ordinarily separated from the sheets W held in the paper tray 41 or the manual feed tray 70. At a point after the expansion process for image data has been completed, the pickup roller 46 or the pickup roller 72 are moved into a position contacting one sheet W to convey the one sheet W and, after feeding the one sheet W, are again separated from the sheets W. For this reason, an expansion delay error does not occur during the initial printing operation on the sheet W supplied from the paper tray 41 or the manual feed tray 70.

The CPU 31 checks the progress of the expansion process upon determining that the back-side printed sheet has approached the registration rollers 47 based on a detection signals from the sensors 39A, for example, and determines whether an expansion delay error has occurred based on this progress.

When the CPU 31 determines that an expansion delay error has occurred (S19: YES), the CPU 31 halts the duplex printing process and the conveying operations of the conveying mechanism 38 and executes an expansion delay error process in S21. Since the CPU 31 halts operations of the printing unit and the like when an expansion delay error occurs, the printer 30 can prevent an unnecessary continuation of the duplex printing process.

Figure 9:
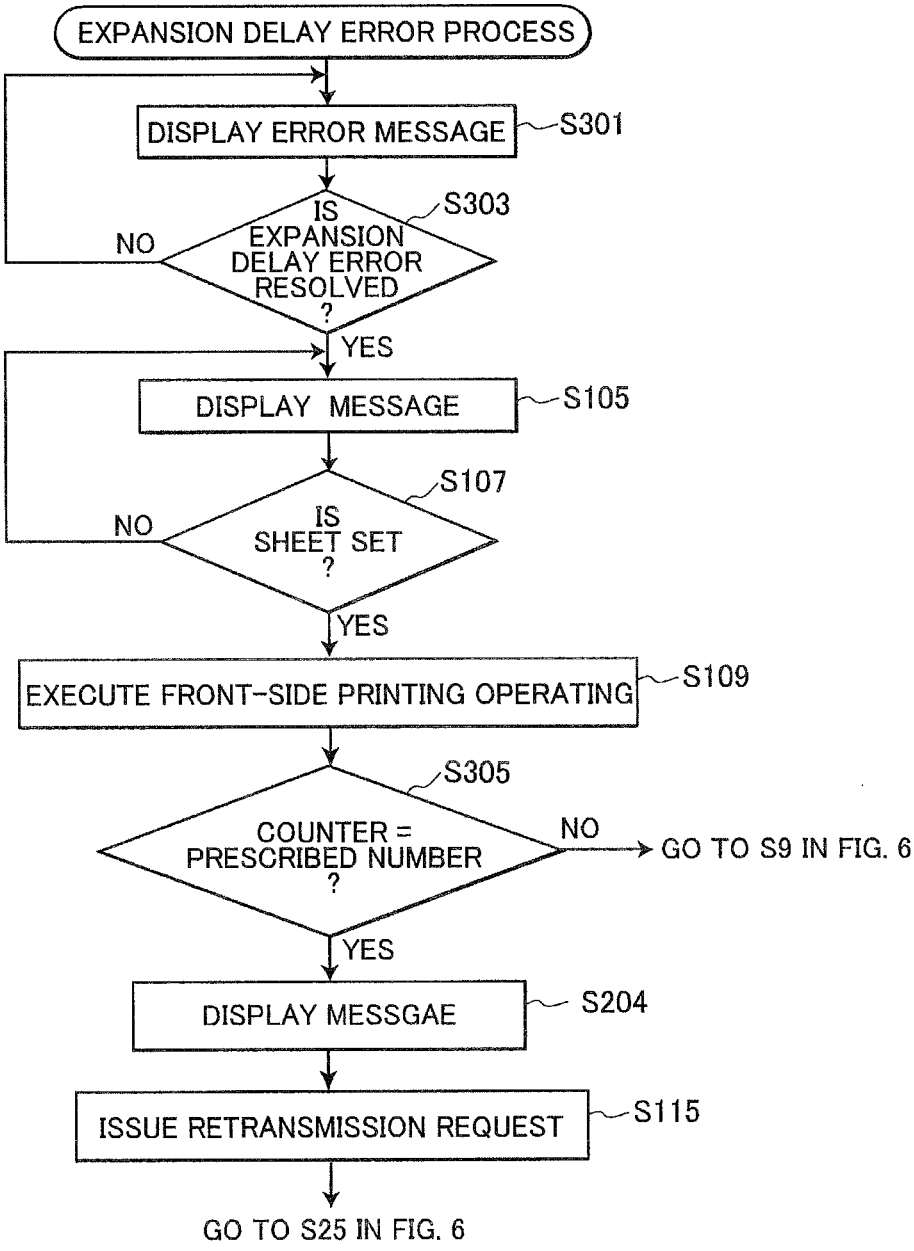
FIG. 9 is a flowchart illustrating steps in an expansion delay error process.

FIG. 9 is a flowchart illustrating steps in the expansion delay error process. Since some of the steps in this process are the same with the switchback error process of FIG. 7 and the sheet size error process of FIG. 8, these steps have been designated with the same step numbers to avoid duplicating description. In S301 of FIG. 9, the CPU 31 displays an error message with graphics on the display unit 36 indicating that an expansion delay error has occurred. This display can notify the user that an expansion delay error has occurred. The user removes one or more back-side printed sheet from the printer 30, for example. Alternatively, the conveying mechanism 38 may convey and discharge the one or more back-side printed sheet on the discharge tray 42 without printing image on the front side.

In S303 the CPU 31 determines whether the expansion delay error has been resolved based on the progress of the expansion process at the current time, for example. If the CPU 31 determines that the error has been resolved (S303: YES), the CPU 31 executes the processes of S105, S107, and S109 described above.

In S305 the CPU 31 increments a counter indicating the number of times that expansion delay error has occurred and determines whether this counter has reached a prescribed number (a plurality of times). If the counter has not reached the prescribed number (S305: NO), the CPU 31 advances to S9 of FIG. 6 to determine whether all pages of the printing operation have been completed. When the printing operation has not been completed for all pages (S9: NO), the CPU 31 continues the duplex printing operation for the next page of image data according to the automatic duplex method.

However, if the counter has reached the prescribed number (S305: YES), in S204 the CPU 31 displays a message on the display unit 36 indicating that the printing method will be switched to the manual duplex method, and subsequently advances to S115. Accordingly, the CPU 31 switches the duplex method from the automatic duplex method to the manual duplex method in the case where the plurality of sets of image data that has large amounts of print data and therefore that requires too much time to perform the expansion process are sequentially sent to the printer 30 from the terminal device 10.

Next, as an example, a duplex printing operation according to the 2-4-1-3 method shown in FIG. 4B will be described in detail for a case in which an expansion delay error has occurred after the printer 30 printed an image for page 4 on the back side of the second sheet W2 (at the point indicated by X in FIG. 4B). When an expansion delay error occurs in this example, the printer 30 displays in S105 instructions on the display unit 36 prompting the user to reset the first sheet W1 on which the image for page 2 has been printed in the manual feed tray 70 with the unprinted surface facing upward. Accordingly, in S109 the printer 30 can print an image for page 1 on the unprinted surface of the first sheet W1 without using the switchback conveying path P2.

When subsequently executing the manual duplex method (S305: YES), in S115 the CPU 31 issues a retransmission request to the terminal device 10. In response, the terminal device 10 retransmits image data for pages of the sheets on which the printer 30 has not printed images completely, to the printer 30 in the sequence page 4, page 6, page 3, and page 5. After the user has set the second sheet W2 with the image for page 4 printed thereon and the unprinted third sheet W3 in the manual feed tray 70, the CPU 31 conveys the second sheet W2 without printing an image for page 4 thereon, subsequently prints an image for page 6 on the back side of the third sheet W3, and discharges both sheets onto the discharge tray 42.

Next, the user resets the two discharged sheets W in the manual feed tray 70 with the unprinted surfaces (front sides) facing upward. Thereafter, the CPU 31 prints an image for page 3 on the front side of the sheet having an image for page 4 printed on the back side thereof and prints an image for page 5 on the front side of a sheet having an image for page 6 printed on the back side thereof, discharging both sheets sequentially onto the discharge tray 42. Accordingly, the printer 30 can perform duplex printing for images of the unprinted pages according to the manual duplex method without using the switchback conveying path P2.

As described above, when a front-side printing error occurs on the printer 30 according to the embodiment, the printer 30 executes a front-side printing operation on a sheet supplied from the paper tray 41 (a back-side printed sheet that is reset in the paper tray 41 after the front-side printing error occurs or a new unprinted sheet). Accordingly, the printer 30 can print the image intended for this front side of the sheet W, even after a front-side printing error has occurred.

Further, when a front-side printing error occurs, the printer 30 can switch the printing method to a manual duplex method that does not use the switchback conveying path P2 from an automatic duplex printing method that uses the switchback conveying path P2. In this way, the printer 30 can avoid a recurrence of the front-side printing error caused by use of the switchback conveying path P2. Moreover, the printer 30 can switch printing methods according to the user's wish.

Further, the printer 30 can continue printing according to an automatic duplex method when the occurrence rate of the expansion delay error is low, switching to the manual duplex method only when the occurrence rate becomes high.

5. Variations on the Embodiment

While the invention has been described in detail with reference to the embodiment thereof, it would be apparent to those skilled in the art that various changes and modifications may be made therein without departing from the spirit of the invention.

(1) In the embodiment described above, an LED type printer 30 is used as an example of the printing device, but the invention is not limited to this type of device. For example, the invention may be applied to an electrophotographic image-forming device employing a polygon mirror system or the like, or an inkjet-type image-forming device. The invention may also be applied to a color printer employing four or more colors, or a single-color (monochrome) printer.

(2) In the embodiment described above, a switchback error, expansion delay error, and sheet size error serve as examples of front-side printing errors, but the invention is not limited to these types of errors. For example, the printing device of the invention may also be configured to handle toner errors occurring when there is insufficient toner in the toner-accommodating section 55 of the process cartridge 51. In other words, the invention can handle any errors that prevent printing on one side of a sheet after another side has been printed.

(3) In the embodiment described above, the user inputs a print request and sets printing conditions on the terminal device 10, but the invention is not limited to this configuration. For example, the print data may be stored on the hard disk drive 34 of the printer 30 or in an external memory device, and the printer 30 may execute a duplex printing process based on this print data when the user issues a request on the operating unit 35 to execute the duplex printing process.

(4) In the embodiment described above, the printer 30 automatically switches from the automatic duplex method to the manual duplex method when the expansion delay error has occurred a prescribed number of times, but only does so for the expansion delay error. However, the printer 30 according to the invention may also be configured to switch to the manual duplex method automatically when a switchback error, a sheet size error, or other error has occurred a prescribed number of times. Specifically, the printer 30 may switch to the manual duplex method automatically, for example, when the switchback error has occurred a prescribed number of times, or when the sheet size error has occurred a prescribed number of times. Alternatively, the printer 30 may switch to the manual duplex method automatically when the total number of times that the errors including the expansion delay error, the switchback error, the sheet size error, and other error occur reaches a prescribed number of times.

(5) In the embodiment described above, the printer 30 switches to the manual duplex method when a front-side printing error has occurred, but the invention is not limited to this configuration. For example, the printer 30 may be configured to switch to a one-sided printing operation instead of a duplex printing method. In other words, the printer 30 avoids a recurrence of the front-side printing error by printing without using the switchback conveying path P2.

(6) In each of the switchback error processes of FIGS. 7-9, in response to the message displayed on the display unit 36 in S105, the user may set a new unprinted sheet in the manual feed tray 70 instead of setting the back-side printed sheet. In this case, in S109 the CPU 31 executes a front-side printing operation on the new unprinted sheet.

More specifically, in the present modification, in S105 the CPU 31 displays a message on the display unit 36 prompting the user to set one of the back-side printed sheet and a new unprinted sheet in the manual feed tray 36 and prompting the user to input, by the operating unit 35, information specifying which sheet (the back-side printed sheet or the new unprinted sheet) is set in the manual feed tray 36. In response to the message displayed on the display unit 36, the user sets one of the back-side printed sheet and a new unprinted sheet in the manual feed tray 70 and inputs, by the operating unit 35, the information specifying which sheet is set in the manual feed tray 36. If the user sets the new unprinted sheet in the manual feed tray 70, the user further inputs information specifying which is to be performed on the new unprinted sheet among the automatic duplex method, the manual duplex method, and the one-sided print method. In this case, S109 is modified as described below. If the user inputs information specifying that the back-side printed sheet is set in the manual feed tray 70, the CPU 31 executes the front-side printing operation is the same manner as in the embodiment described above. If the user inputs information specifying that the new unprinted sheet is set in the manual feed tray 70 and that the one-sided print is to be performed on the new unprinted sheet, in S109 the CPU 36 executes the front-side printing to print an image on the front side of the new unprinted sheet. In this case, only the front-side of the new unprinted sheet will be printed with the image that should have been printed on the front side of the back-side printed sheet but was not printed on the front side of the back-side printed sheet.

If the user inputs information specifying that a new unprinted sheet is set in the manual feed tray 70 and information specifying that the manual duplex print is to be performed on the new unprinted sheet, in S109 the CPU 31 performs the front-side printing operation on the new unprinted sheet by using the conveying path P1 and discharges the sheet on the discharge tray 42. Subsequently, the CPU 31 issues a transmission request to retransmit image data corresponding to the image that was formed on the back-side printed sheet immediately before the front-side print error has occurred. The CPU 31 further displays a message prompting the user to set the sheet whose front side has been just printed with an image in the manual feed tray 70 with the front side facing downward. If the CPU 31 determines that the sheet W has been set in the manual feed tray 70 based on a detection signal received from the sheet sensor (not shown), the CPU 31 executes the back-side printing operation based on the retransmitted image data and proceeds to the subsequent process (S111, S204, or S305). In this case, the user will replace the back-side printed sheet with the newly both-side printed sheet.

If the user inputs information specifying that a new unprinted sheet is set in the manual feed tray 70 and that the automatic duplex print is to be performed on the new unprinted sheet, in S109 the CPU 31 first prints an image on the front side of the new unprinted sheet by using the conveying path P1 and further conveys the front-side printed sheet to the switchback conveying path P2. While conveying the front-side printed sheet to the switchback conveying path P2, the CPU 31 issues a transmission request to retransmit image data corresponding to the image that was formed on the back-side printed sheet immediately before the front-side print error has occurred. The CPU 31 prints an image on the back side of the front-side printed sheet based on the retransmitted image data and proceeds to the subsequent process (S111, S204, or S305). In this case, the user will replace the back-side printed sheet with the newly both-side printed sheet.

What is claimed is:

1. A printing device comprising:

an accommodating unit configured to accommodate a sheet having one side and another side;

a first receiving unit configured to receive first print data from an external device and second print data from the external device, the first print data including a plurality of sets of image data to be printed according to a first prescribed order, the second print data including the plurality of sets of image data to be printed according to a second prescribed order different from the first prescribed order, the plurality of sets of image data corresponding to a plurality of images;

a printing unit configured to be capable of printing the plurality of images based on the first print data at a printing position and to be capable of printing the plurality of images based on the second print data at the printing position;

a conveying mechanism having a first path configured to convey the sheet from the accommodating unit to the printing position and a second path configured to convey the sheet that has once passed through the printing position to the printing position in an inverted state;

a processor; and a memory storing computer-readable instructions therein, the computer-readable instructions, when executed by the processor, causing the printing device to perform:

controlling the conveying mechanism to perform an automatic duplex print for printing images on both of the one and another sides of the sheet and controlling the printing unit to print the plurality of images according to the prescribed first order based on the first print data, printing on the one side being executed by using the first path and printing on the another side being executed by using the second path;

controlling the conveying mechanism to perform an operation for printing an image on a sheet by the printing unit using the first path and without using the second path and controlling the printing unit to print the plurality of images according to the prescribed second order based on the second print data;

controlling the first receiving unit to receive the first print data from the external device;

requesting the external device to transmit the second print data including the plurality of sets of image data after the first receiving unit receives the first print data from the external device;

discarding the received first print data including the plurality of sets of image data that are included in the second print data after the requesting requests the external device to transmit the second print data; and determining, using a sensor, whether an another side printing error occurs after the first receiving unit receives the first print data from the external device, the another side printing error being one of switchback error, sheet size error, and expansion delay error, and causing the controlling to disable printing of an image on the another side of the sheet based on the first print data to be printed on the another side, by using the second path after one side of the sheet has already been printed, wherein when the determining determines that the another side printing error does not occur, the controlling controls the conveying mechanism to convey, through the second path, the sheet whose one side has already been printed to the printing unit and controlling the printing unit to print an image on the another side based on the first print data to be printed on the another side; and wherein when the determining determines that the another side printing error occurs, the requesting requests the external device to transmit the second print data, the discarding discards the received first print data, and the controlling controls the conveying mechanism to convey, through the first path, a plurality of sheets that is set in the accommodating unit and controls the printing unit to print the image on the plurality of sheets based on the second print data.

2. The printing device according to claim 1, wherein the computer-readable instructions, when executed by the processor, cause the printing device to further perform halting the printing operation by the printing unit and the conveying operation by the conveying mechanism when the determining determines that the another side printing error occurs.

3. The printing device according to claim 1, wherein the computer-readable instructions, when executed by the processor, cause the printing device to further perform, after the controlling controls the printing unit to print the image on the sheet based on a set of image data in the first print data to be printed on the another side, initiating a switch from the automatic duplex print to the operation for printing an image on a sheet by the printing unit using the first path and without using the second path.

4. The printing device according to claim 1, wherein the computer-readable instructions, when executed by the processor, cause the printing device to further perform initiating, after the controlling controls the printing unit to print the image on the sheet based on a set of image data in the first print data to be printed on the another side, a switch from the automatic duplex print to a manual duplex print for printing images on one and another sides of a sheet that is set in the accommodating unit using the first path and without using the second path.

5. The printing device according to claim 3, wherein the computer-readable instructions, when executed by the processor, cause the printing device to further perform counting a number of times that the another side printing error has occurred; and wherein the initiating initiates the switch from the automatic duplex print to the operation for printing image on a sheet by the printing unit using the first path and without using the second path when the number of times counted by the counting reaches a prescribed number.

6. The printing device according to claim 1, wherein computer-readable instructions, when executed by the processor, cause the printing device to further perform executing an expansion process for generating a set of expanded image data by expanding a set of image data in the first print data, the printing unit being configured to print an image based on the set of expanded image data; and wherein the determining determines that the another side printing error occurs when the expansion process is not complete before a sheet whose one side has already been printed is conveyed to the printing unit through the second path.

7. The printing device according to claim 3, further comprising a second receiving unit that is configured to receive an instruction inputted by a user to initiate the switch from the automatic duplex print to the operation for printing image on a sheet by the printing unit using the first path and without using the second path, wherein the initiating initiates the switch from the automatic duplex print to the operation for printing image on a sheet by the printing unit using the first path and without using the second path when the second receiving unit receives the user's instruction to switch from the automatic duplex print to the operation for printing image on a sheet by the printing unit using the first path and without using the second path after the determining determines that the another side printing error occurs.

8. The printing device according to claim 3, wherein during the automatic duplex print, the first receiving unit receives the plurality of sets of image data in the first print according to the prescribed first order from the external device;

wherein the computer-readable instructions, when executed by the processor, cause the printing device to further perform instructing, when the initiating initiates the switch from the automatic duplex print to the operation for printing image on a sheet by the printing unit using the first path and without using the second path, the external device to output the plurality of set of image data in the second print data according to the prescribed second order; and wherein when the initiating the switch from the automatic duplex print to the operation for printing image on a sheet by the printing unit using the first path and without using the second path, the first receiving unit receives the plurality of sets of image data in the second print data according to the prescribed second order.

9. The printing device according to claim 1, wherein the plurality of sets of image data include first image data indicating a first image; and wherein when the printing unit has printed the first image based on the first image data in the first print data, the requesting requests the external device to transmit the second print data that does not include the first image data based on which the printing unit has printed the first image, the second print data including a plurality of remaining sets of image data consisting of the plurality of sets of image data except the first image data, the remaining sets of image data being included in the first print data.

10. A printing device comprising:

an accommodating unit configured to accommodate a sheet having one side and another side;

a first receiving unit configured to receive first print data from an external device and second print data from the external device, the first print data including a plurality of sets of image data to be printed according to a first prescribed order, the second print data including the plurality of sets of image data to be printed according to a second prescribed order different from the first prescribed order, the plurality of sets of image data corresponding to a plurality of images;

a printing unit configured to be capable of printing the plurality of images based on the first print data at a printing position and to be capable of printing the plurality of images based on the second print data at the printing position;

a conveying mechanism having a first path configured to convey the sheet from the accommodating unit to the printing position and a second path configured to convey the sheet that has once passed through the printing position to the printing position in an inverted state;

a processor; and a memory storing computer-readable instructions therein, the computer-readable instructions, when executed by the processor, causing the printing device to perform:

controlling the conveying mechanism to perform an automatic duplex print for printing images on both of the one and another sides of the sheet and controlling the printing unit to print the plurality of images according to the prescribed first order based on the first print data, printing on the one side being executed by using the first path and printing on the another side being executed by using the second path;

controlling the conveying mechanism to perform an operation for printing an image on a sheet by the printing unit using the first path and without using the second path and controlling the printing unit to print the plurality of images according to the prescribed second order based on the second print data;

controlling the first receiving unit to receive the first print data from the external device;

requesting the external device to transmit the second print data including the plurality of sets of image data after the first receiving unit receives the first print data from the external device;

discarding the received first print data including the plurality of sets of image data that are included in the second print data after the requesting requests the external device to transmit the second print data; and determining, using a sensor, whether an another side printing error occurs after the first receiving unit receives the first print data from the external device, the another side printing error causing the controlling to disable printing of an image on the another side of the sheet based on the first print data to be printed on the another side, by using the second path after one side of the sheet has already been printed; and counting number of times that the another side printing error has occurred, wherein when the determining determines that the another side printing error does not occur, the controlling controls the conveying mechanism to convey, through the second path, the sheet whose one side has already been printed to the printing unit and controlling the printing unit to print an image on the another side based on the first print data to be printed on the another side, and wherein when the number of times counted by the counting reaches a prescribed number, the printing device stops performing the controlling to control the conveying mechanism to perform the automatic duplex print and stops performing the controlling to control the printing unit to print the plurality of images according to the prescribed first order based on the first print data, and the printing device performs the requesting to request the external device to transmit the second print data, the discarding to discard the received first print data, and the controlling to control the conveying mechanism to convey, through the first path, a plurality of sheets that is set in the accommodating unit and to control the printing unit to print the image on the plurality of sheets based on the second print data.

11. A printing device comprising:

an accommodating unit configured to accommodate a sheet having one side and another side;

a first receiving unit configured to receive first print data from an external device and second print data from the external device, the first print data including a plurality of sets of image data to be printed according to a first prescribed order, the second print data including the plurality of sets of image data to be printed according to a second prescribed order different from the first prescribed order, the plurality of sets of image data corresponding to a plurality of images, the plurality of sets of image data including first image data indicating a first image;

a printing unit configured to be capable of printing the plurality of images based on the first print data at a printing position and to be capable of printing the plurality of images based on the second print data at the printing position;

a conveying mechanism having a first path configured to convey the sheet from the accommodating unit to the printing position and a second path configured to convey the sheet that has once passed through the printing position to the printing position in an inverted state;

a processor; and a memory storing computer-readable instructions therein, the computer-readable instructions, when executed by the processor, causing the printing device to perform:

controlling the conveying mechanism to perform an automatic duplex print for printing images on both of the one and another sides of the sheet and controlling the printing unit to print the plurality of images according to the prescribed first order based on the first print data, printing on the one side being executed by using the first path and printing on the another side being executed by using the second path;

controlling the conveying mechanism to perform an operation for printing an image on a sheet by the printing unit using the first path and without using the second path and controlling the printing unit to print the plurality of images according to the prescribed second order based on the second print data;

controlling the first receiving unit to receive the first print data from the external device;

requesting the external device to transmit the second print data including the plurality of sets of image data after the first receiving unit receives the first print data from the external device;

discarding the received first print data including the plurality of sets of image data that are included in the second print data after the requesting requests the external device to transmit the second print data; and determining, using a sensor, whether an another side printing error occurs after the first receiving unit receives the first print data from the external device, the another side printing error causing the controlling to disable printing of an image on the another side of the sheet based on the first print data to be printed on the another side, by using the second path after one side of the sheet has already been printed, wherein when the determining determines that the another side printing error does not occur, the controlling controls the conveying mechanism to convey, through the second path, the sheet whose one side has already been printed to the printing unit and controlling the printing unit to print an image on the another side based on the first print data to be printed on the another side;

wherein when the determining determines that the another side printing error occurs, the requesting requests the external device to transmit the second print data, the discarding discards the received first print data, and the controlling controls the conveying mechanism to convey, through the first path, a plurality of sheets that is set in the accommodating unit and controls the printing unit to print the image on the plurality of sheets based on the second print data; and wherein when the printing unit has printed the first image based on the first image data in the first print data, the requesting requests the external device to transmit the second print data that does not include the first image data based on which the printing unit has printed the first image, the second print data including a plurality of remaining sets of image data consisting of the plurality of sets of image data except the first image data, the remaining sets of image data being included in the first print data.

* * * * *